US009853346B2

(12) United States Patent
Skrepcinski et al.

(10) Patent No.: US 9,853,346 B2
(45) Date of Patent: Dec. 26, 2017

(54) HIGH CAPACITY SECTOR MOUNT

(71) Applicant: CommScope Technologies LLC, Hickory, NC (US)

(72) Inventors: Alan J. Skrepcinski, Plano, TX (US); Michael S. McFall, Mansfield, TX (US); Kevin L. Rovell, Fort Worth, TX (US); Allen D. Willis, North Richland Hills, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/000,036

(22) Filed: Jan. 19, 2016

(65) Prior Publication Data

US 2016/0211569 A1 Jul. 21, 2016

Related U.S. Application Data

(60) Provisional application No. 62/104,898, filed on Jan. 19, 2015.

(51) Int. Cl.
*H01Q 1/12* (2006.01)

(52) U.S. Cl.
CPC ..... *H01Q 1/1228* (2013.01)

(58) Field of Classification Search
CPC ..... H01Q 1/1228; H01Q 1/12; H01Q 9/34; H01Q 1/1242; E04H 12/00
USPC ..... 248/201, 218.4, 219.3, 519, 515, 536, 248/540, 541; 343/872, 890, 892
See application file for complete search history.

(56) References Cited

U.S. PATENT DOCUMENTS 2,928,641 A * 3/1960 Pfaff, Jr. ..... G08G 1/095 248/201
4,010,925 A * 3/1977 Garchinsky ..... G08G 1/095 248/295.11
5,787,673 A * 8/1998 Noble ..... E04H 12/085 343/890
5,920,291 A * 7/1999 Bosley ..... H01Q 1/1207 343/879
5,971,345 A 10/1999 Khalaf
7,086,207 B2 8/2006 Piburn et al.
7,113,145 B1 * 9/2006 Noble ..... H01Q 1/1228 248/218.4

(Continued)

*Primary Examiner* — Muhammad Ijaz
(74) *Attorney, Agent, or Firm* — Myers Bigel, P.A.

(57) ABSTRACT

An antenna mount includes first and second tower mounting brackets. A first frame has first and second portions attached to the first and second tower mounting brackets, respectively. A second frame has third and fourth portions attached to the first and second tower mounting brackets, respectively. First and second equipment brackets are attached to the first frame, and third and fourth equipment brackets are attached to the second frame. Optionally, the first and second frames may each be formed as a one-piece continuous bent tube. Optionally, the first portion and the third portion are located side-by-side and clamped to the first tower bracket by a same first clamp, and the second portion and the fourth portion are located side-by-side and clamped to the second tower bracket by a same second clamp. Optionally, each equipment bracket has a frame face and an equipment face, wherein the frame face is orthogonal to the equipment face and extends in a direction which intersects a plane containing the equipment face at an angle of approximately 10 to 80 degrees.

20 Claims, 11 Drawing Sheets

(56) References Cited

U.S. PATENT DOCUMENTS

| | | | | |
|---|---|---|---|---|
| D532,412 | S | 11/2006 | Yang | |
| 7,466,286 | B2 * | 12/2008 | Chapman | H01Q 1/1228 343/874 |
| 7,659,865 | B2 * | 2/2010 | Kreitzberg | H01Q 1/1235 343/880 |
| 8,939,143 | B2 | 1/2015 | Zuritis | |
| 9,022,332 | B2 * | 5/2015 | Stokes | B66C 1/427 248/218.4 |
| 2004/0130500 | A1 | 7/2004 | Takei | |
| 2006/0087476 | A1 * | 4/2006 | Piburn | H01Q 1/1207 343/890 |
| 2007/0205957 | A1 * | 9/2007 | Chapman | H01Q 1/1235 343/871 |
| 2007/0261355 | A1 * | 11/2007 | Carlisle | H01Q 1/1242 52/633 |
| 2011/0043414 | A1 | 2/2011 | Webb | |
| 2011/0279347 | A1 | 11/2011 | Pass | |
| 2012/0229363 | A1 | 9/2012 | Webb | |
| 2013/0169504 | A1 | 7/2013 | Jenwatanavet | |

* cited by examiner

HIGH CAPACITY SECTOR MOUNT

This application claims the benefit of U.S. Provisional Application No. 62/104,898, filed Jan. 19, 2015, which is herein incorporated by reference.

BACKGROUND OF THE INVENTION

1. Field of the Invention

The present invention relates to a structure, e.g., a metal or steel structure, for supporting radios, antennas and/or similar equipment on a tower.

2. Description of the Related Art

Background art can be seen in U.S. Pat. Nos. 5,920,291, 7,086,207, 7,113,145, 7,466,286 and U.S. Published Patent Application No. 2007/0261355, each of which is herein incorporated by reference.

SUMMARY OF THE INVENTION

With increased demand for more wireless communication, the number of radio and antenna units that a tower traditionally supports has increased and is expected to continue to increase. New towers will need to be designed to support greater numbers of antenna and radio units, while existing towers are retrofitted to support more units and effort is made to fully utilize space available on the towers.

To meet this increased demand, the Applicant has developed a new high capacity sector frame mount, capable of supporting at least about 1200 lbs. (at least about 300 lbs. per antenna pipe) with a reduced overall EPA (Effective Projected Area) and reduced weight that meets ANSI/TIA 222 G-2.

Current antenna mounts are being over loaded with equipment due to increased demand for more bandwidth. More equipment is being mounted on existing structures causing increased stress to tower legs and in some cases sector frame mounting failures. The present invention allows for more equipment weight to be mounted, but offers less EPA, overall weight reduction, fewer parts, and easier installation than other mounts. With reduced weight and EPA, end users can expand their networks without increased tower cost by not having to use more vertical space on the tower to mount additional equipment.

The present invention may be applied to existing or new outside towers in the cellular communication field and/or other types of communication fields. Various aspects of the present invention offer advantages over the state of the art, such as one or more of the following:

1. The use of two one-piece formed structural tubular frames that eliminate the assembly of multiple parts and attach to a tower leg clamp.

2. Face attachment transition angle brackets that selectively attach to the one-piece frame using U-bolts that allow various size face frame antenna mounts to be attached which selectively fix the position for the standoff legs with respect to the frame face.

3. The one-piece tubular frame allows reduced overall weight by eliminating additional parts to be assembled in the field, thereby reducing the amount of time required to install the frame structure.

4. The one-piece tubular frame with reduced parts has an overall lower EPA and reduces exposure of overall wind loads to the structure, which will allow the customer to install more equipment on the structure.

5. The structural tubular frames are attached to an upper and lower structurally welded boxed tower leg clamp, selectively securing the frame attachment to a tower leg bracket with azimuth and taper adjustment. The upper tower leg bracket provides selectively pivotally movable azimuth via a 2 point pivot and taper.

Various aspects of the invention provide one or more of the following benefits relative to the state of the prior art in outside wireless telecommunication cell sites:

A. Capable of supporting higher equipment loading.

B. Reduced EPA.

C. Reduced weight.

D. Reduced parts count and assembly time.

E. Provides azimuth and taper adjustments.

F. Assembly breaks down for compact shipping.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF EMBODIMENTS OF THE INVENTION

Figure 1:
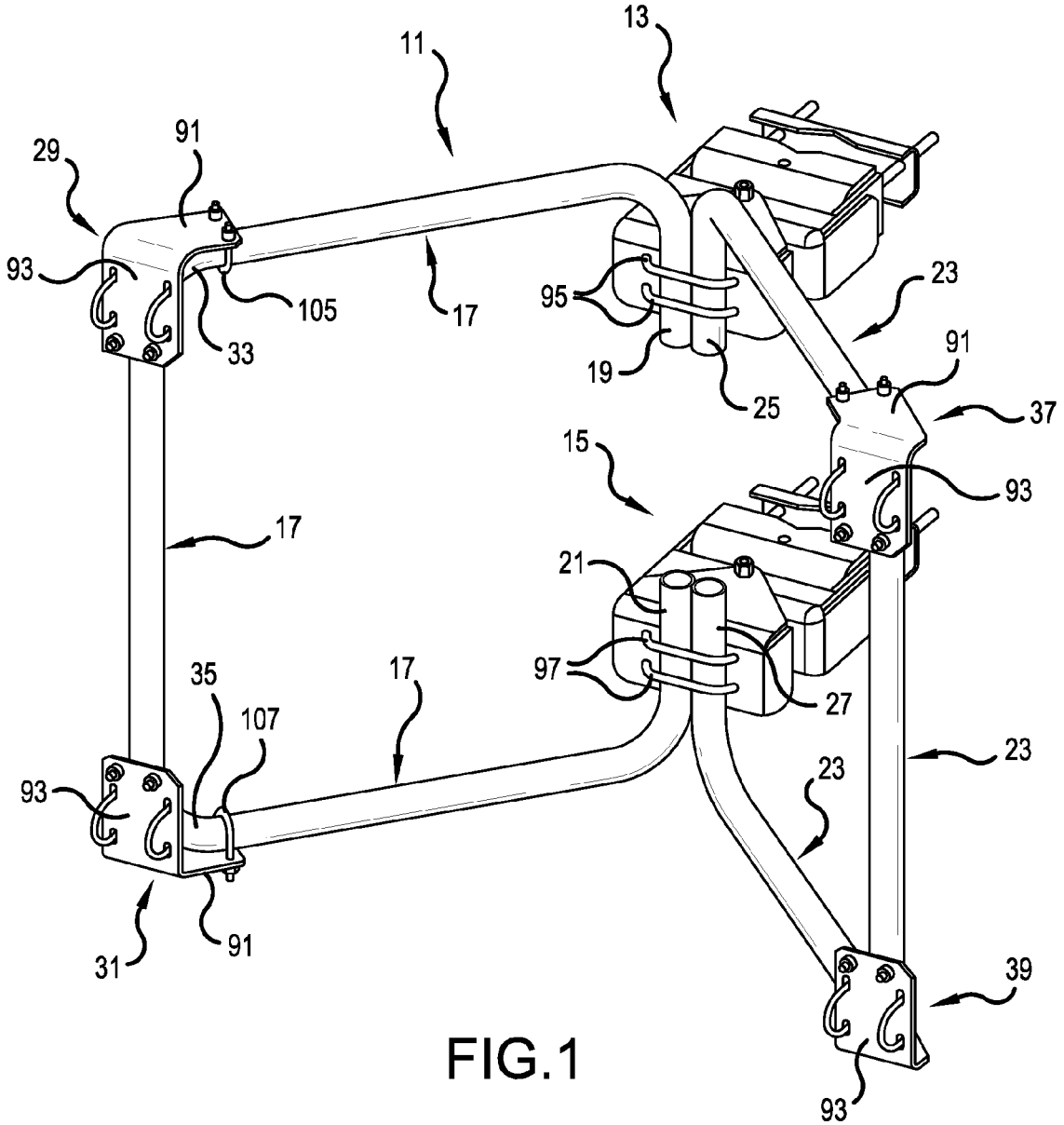
FIG. 1 is a front perspective view of an antenna mount, in accordance with a first embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", an and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Figure 2:
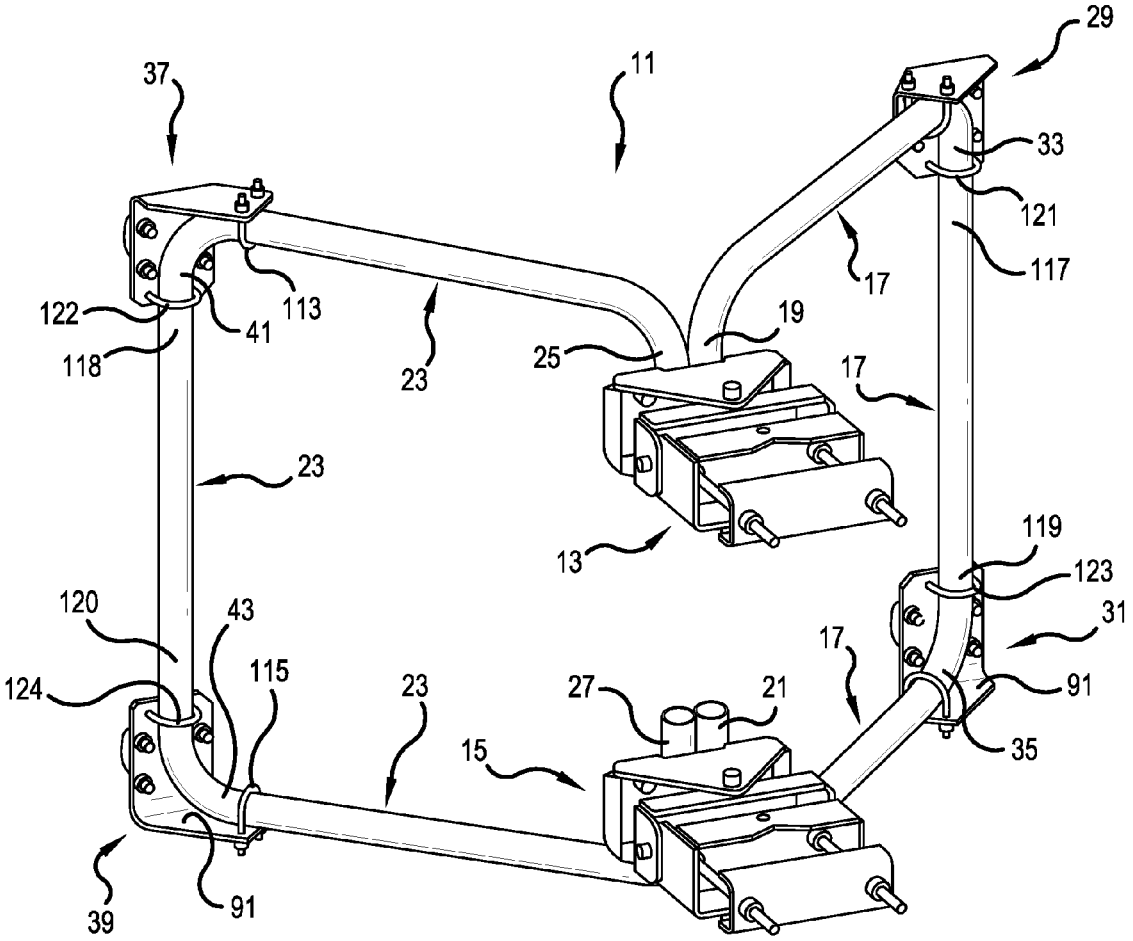
FIG. 2 is a rear perspective view of the antenna mount of FIG. 1.

FIG. 1 is a front perspective view of an antenna mount, in accordance with a first embodiment of the present invention. FIG. 2 is a rear perspective view of the antenna mount of FIG. 1.

With reference to FIGS. 1 and 2, an antenna mount 11 includes a first tower mounting bracket 13 and a second tower mounting bracket 15. A first one-piece continuous bent tube frame 17 has a first portion 19 attached to the first tower mounting bracket 13 and a second portion 21 attached to the second tower mounting bracket 15. The "one-piece continuous" aspect of the first tube frame 17 may be created by initially forming the entire first tube frame 17 as a single unitary piece, or alternatively by attaching segments of the first tube frame 17 together, e.g., by welding, slip-fit, or fasteners.

A second one-piece continuous bent tube frame 23 has a third portion 25 attached to the first tower mounting bracket 13, and a fourth portion 27 attached to the second tower mounting bracket 15. The first portion 19 of the first bent tube frame 17 and the third portion 25 of the second bent tube frame 23 are located side-by-side and are both clamped to the first tower bracket 15 by a same first clamp, such as a first U-bolt 95, more preferably by two first U-bolts 95, spaced apart by one or more inches. The second portion 21 of the first bent tube frame 17 and the fourth portion 27 of the second bent tube frame 23 are located side-by-side and are both clamped to the second tower bracket 15 by a same second clamp, such as a second U-bolt 97, more preferably by two second U-bolts 97, spaced apart by one or more inches.

First and second equipment brackets 29 and 31 are attached to fifth and sixth portions 33 and 35 of the first bent tube frame 17. Third and fourth equipment brackets 37 and 39 are attached to seventh and eighth portions 41 and 43 of the second bent tube frame 23.

In the embodiment of FIGS. 1 and 2, the first bent tube frame 17 presents a first C-shape and the second bent tube frame 23 presents a second C-shape. An opening in the first C-shape of the first bent tube frame 17 exists between the first portion 19 attached to the first tower mounting bracket 13 and the second portion 21 attached to the second tower mounting bracket 15. An opening in the second C-shape of the second bent tube frame 23 exists between the third portion 25 attached to the first tower mounting bracket 13 and the fourth portion 27 attached to the second tower mounting bracket 15.

Figure 3:
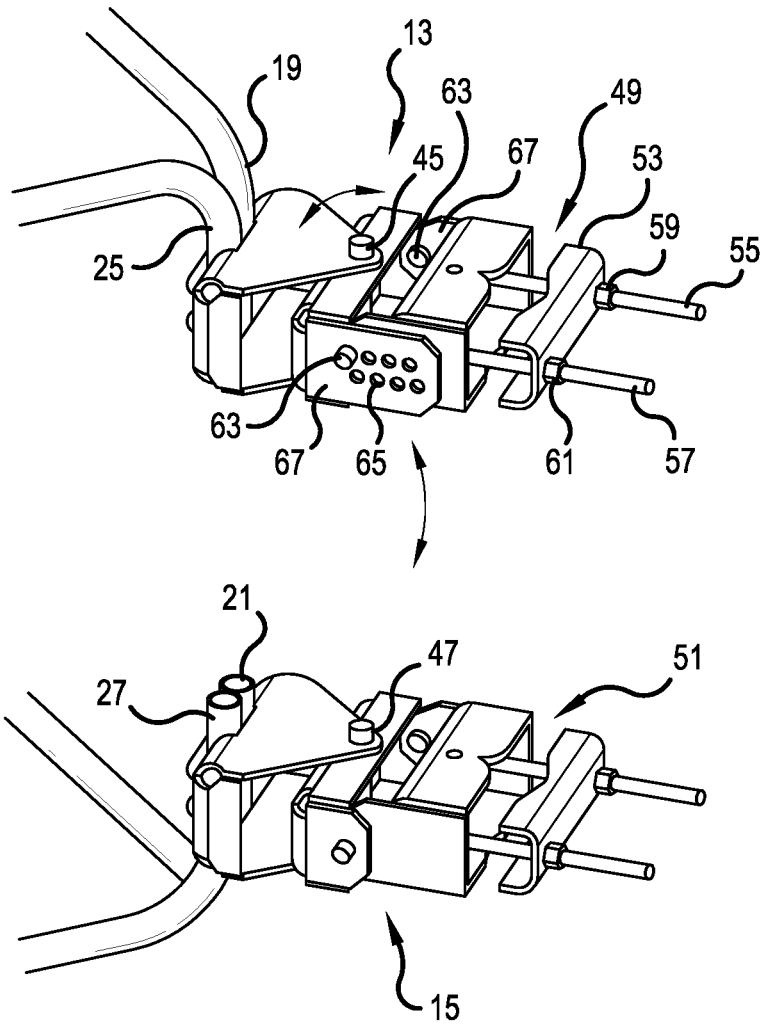
FIG. 3 is a close up, rear perspective view of first and second tower mounting brackets of the antenna mount of FIGS. 1 and 2.

FIG. 3 is a close up rear perspective view of the first and second tower mounting brackets 13 and 15. The first and second tower mounting brackets 13 and 15 clamp onto a common tower leg 100 (See FIG. 5) via first and second tower leg clamps 49 and 51, respectively. The first tower leg clamp 49 may include a plate 53 with two holes receiving two threaded rods 55 and 57 and two nuts 59 and 61 threaded onto the two threaded rods 55 and 57. The first and second tower mounting brackets 13 and 15 offer azimuth adjustment via first and second adjustment bolts 45 and 47, respectively. The first tower mounting bracket 13 may optionally offer upper taper adjustment, via selective placement of mounting bolts 63 into selected apertures from plural apertures 65 in side plates 67.

Figure 4:
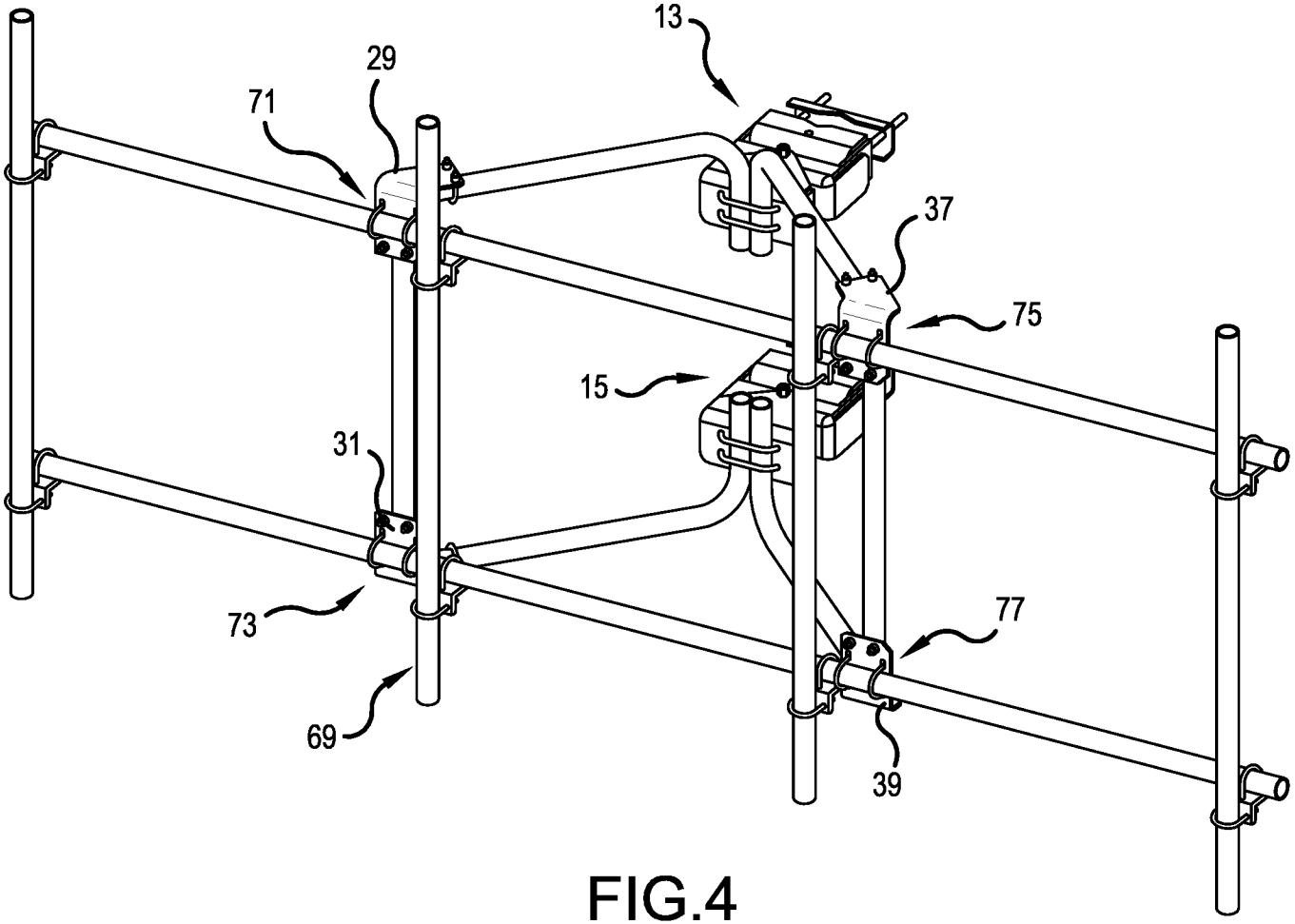
FIG. 4 is a front perspective view of an antenna frame mounted to the antenna mount of FIGS. 1 and 2.

FIG. 4 shows an antenna frame 69 mounted to equipment faces 93 of the first, second, third and fourth equipment brackets 29, 31, 37 and 39. The mounting may be accomplished by first, second, third and fourth equipment bolts 71, 73, 75, and 77, respectively. In a preferred embodiment, each of the first, second, third and fourth equipment bolts 71, 73, 75, and 77 may be comprised of two U-bolts.

Figure 5:
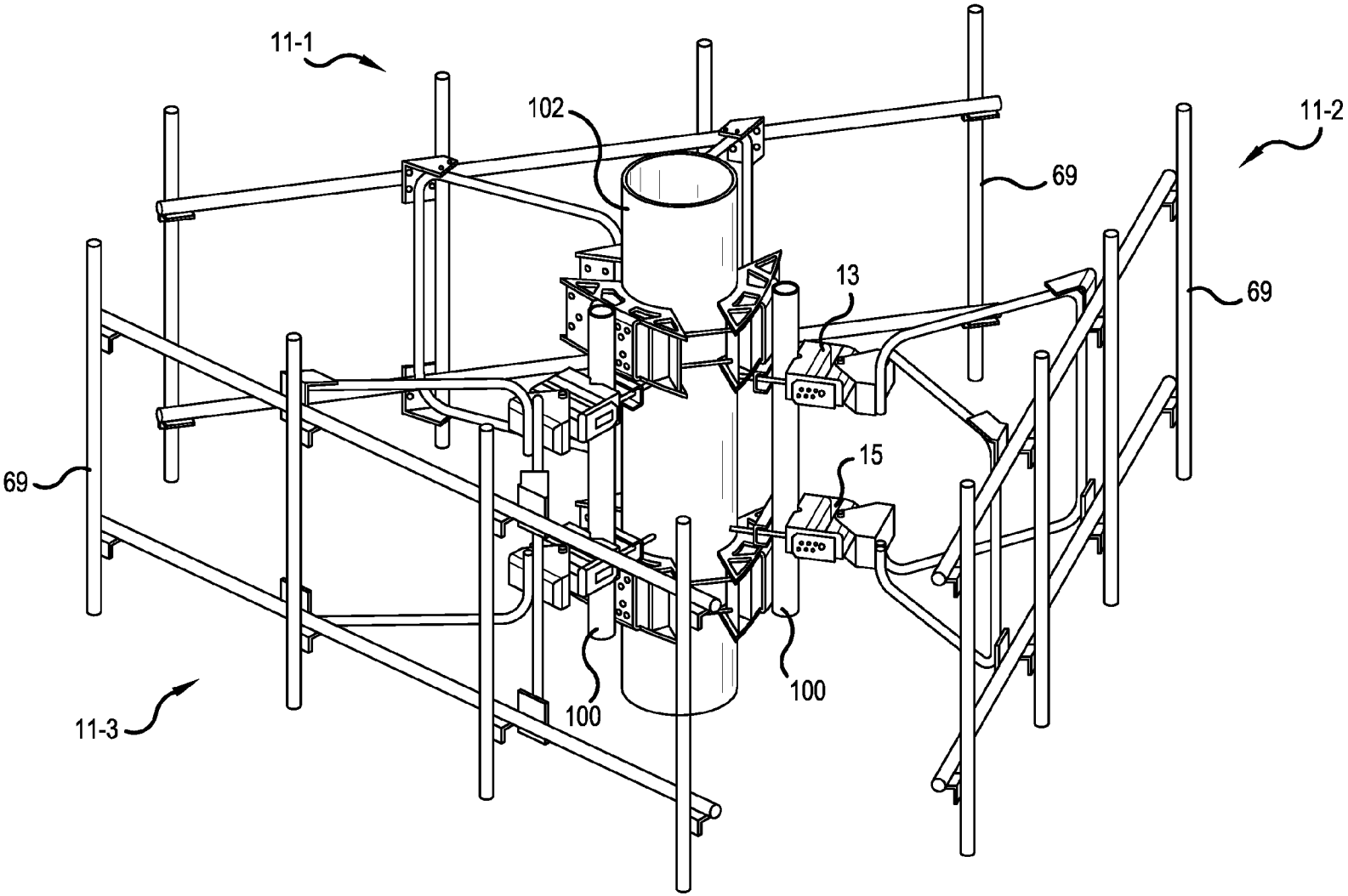
FIG. 5 is a perspective view of three of the antenna frames of FIG. 4 mounted around a monopole.

FIG. 5 shows three of the antenna mounts of FIG. 4, labeled as 11-1, 11-2 and 11-3 in FIG. 5, mounted to three tower legs 100. The three tower legs 100 may be mounted at equally spaced locations, e.g., 120 degrees apart, around a monopole 102.

Figure 6:
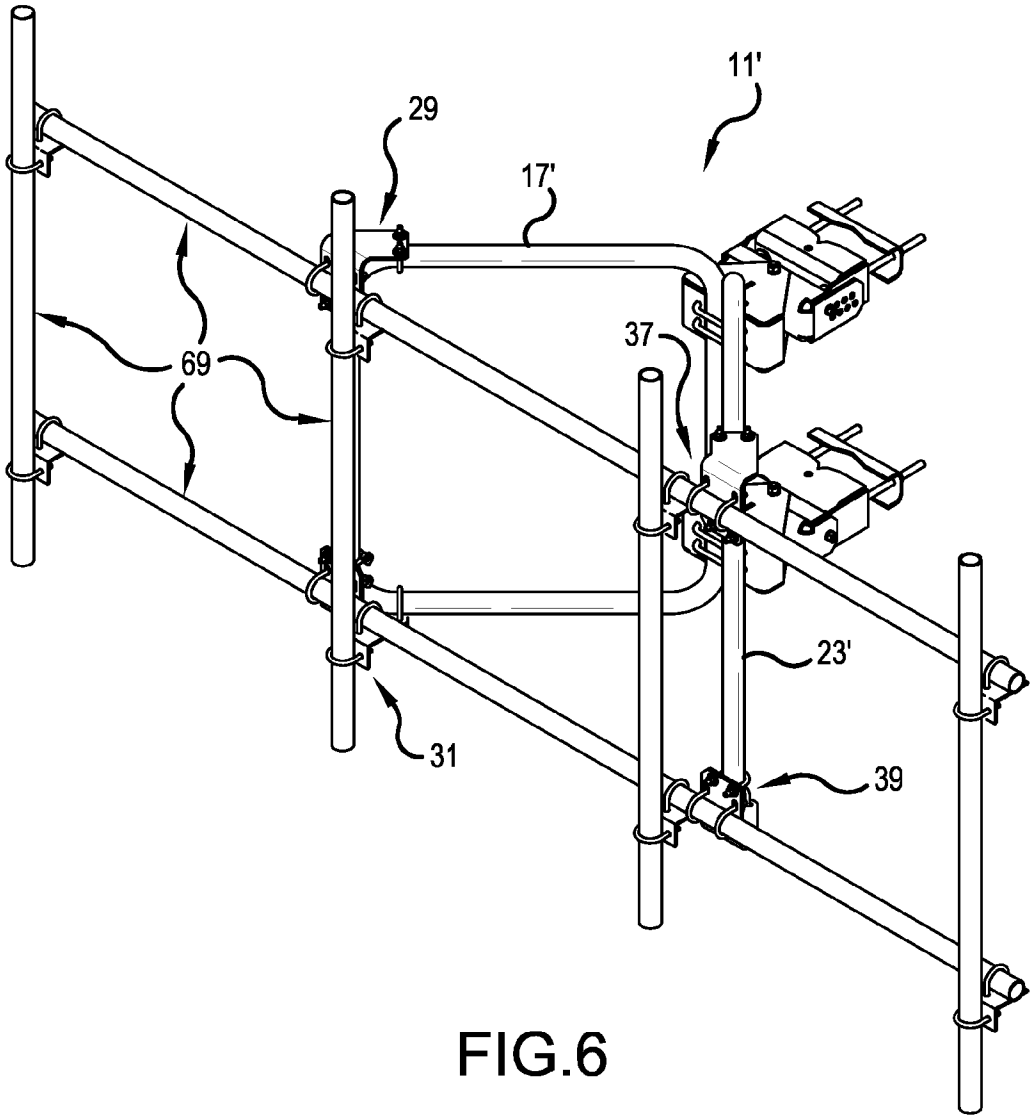
FIG. 6 is a front perspective view of an antenna mount, in accordance with a second embodiment of the present invention, having the antenna frame mounted thereto.
Figure 7:
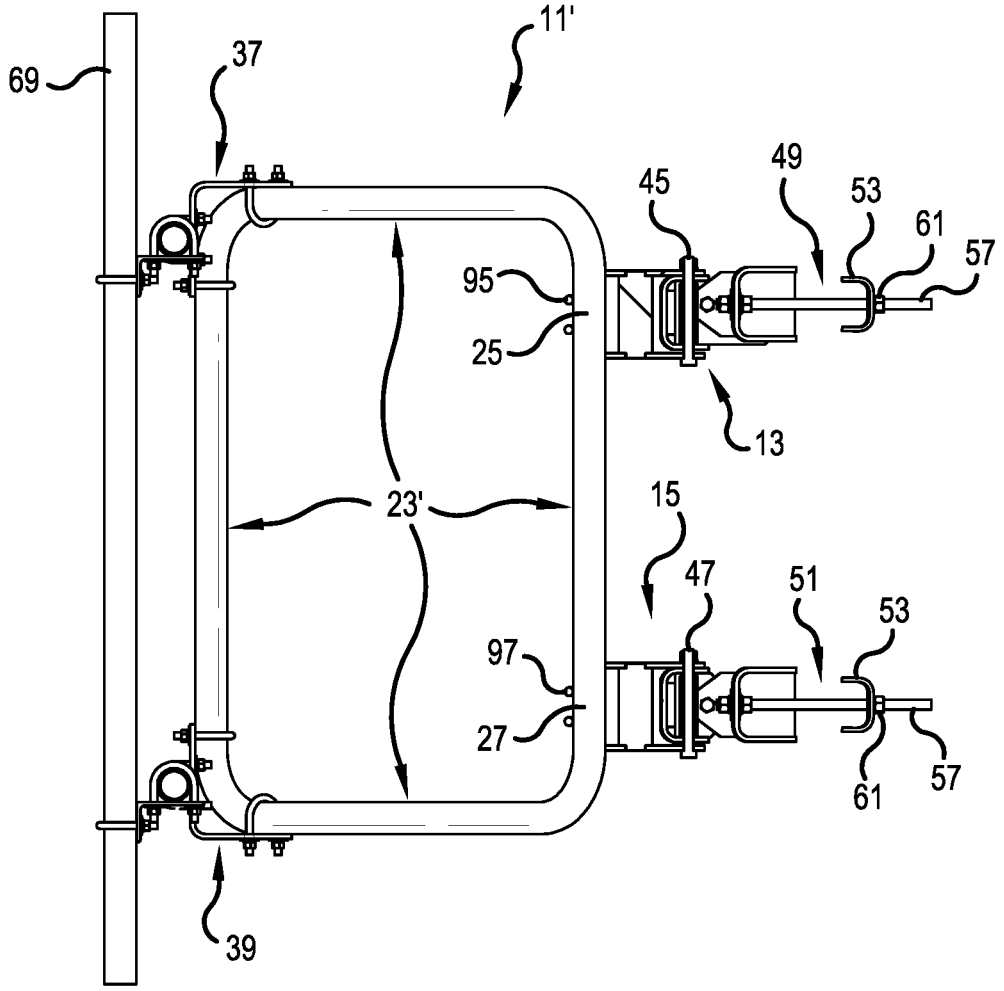
FIG. 7 is a side view of the antenna mount and antenna frame of FIG. 6.

FIG. 6 is a front perspective view of an antenna mount 11', in accordance with a second embodiment of the present invention. FIG. 7 is a side view of the antenna mount 11' of FIG. 6. Like structures, in the relation to the first embodiment, have been labeled with the same reference numerals.

In the embodiment of FIGS. 6 and 7, the first bent tube frame 17' is formed as first closed loop, e.g., a D-shaped member, and the second bent tube frame 23' is formed as a second closed loop, e.g., a D-shaped member. The D-shape may assist in enhancing structural rigidity and stability.

Figure 10:
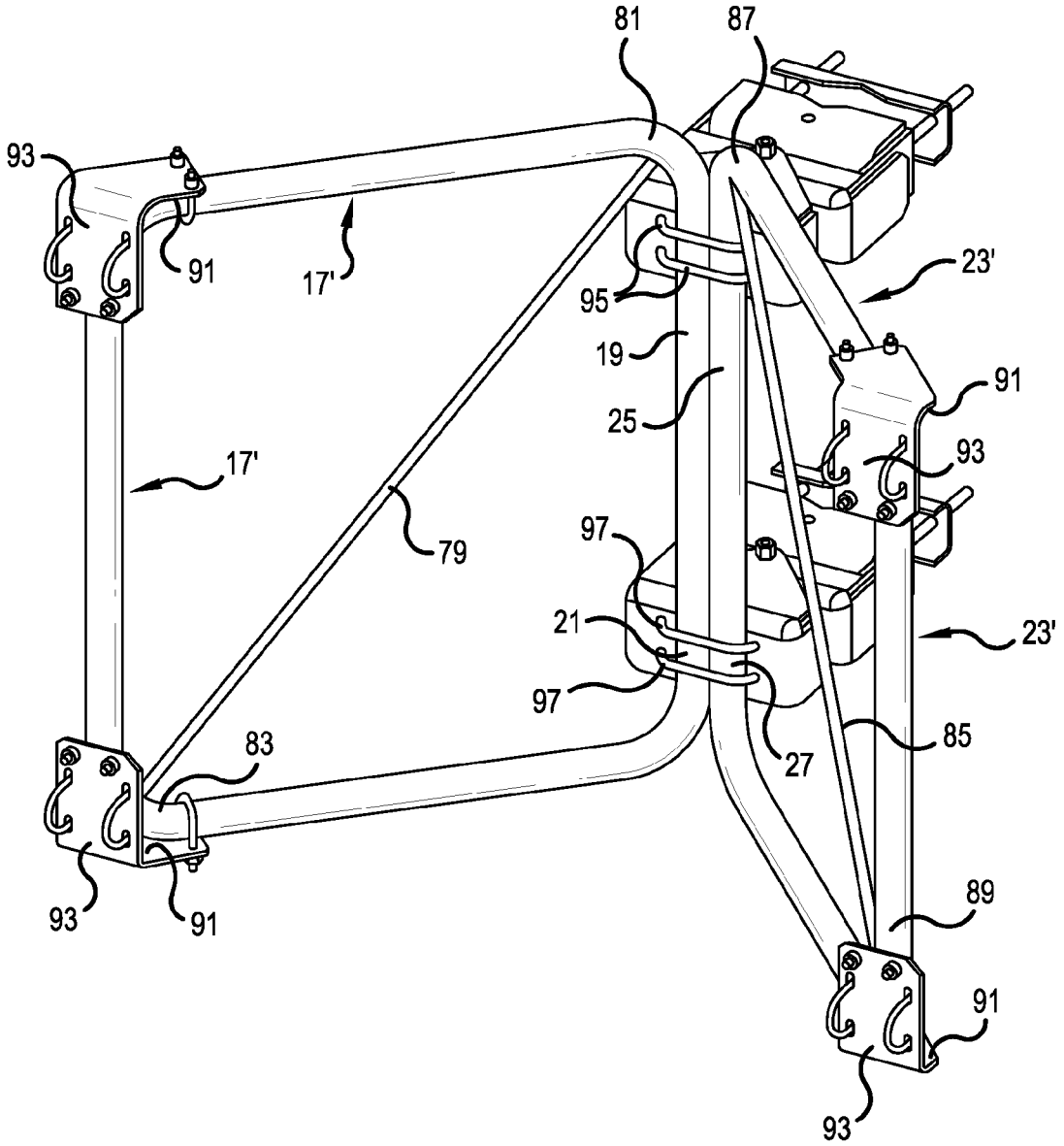
FIG. 10 is a front perspective view of the antenna mount, in accordance with the second embodiment of the present invention, with the antenna frame removed and showing optional cross beams.

As illustrated in FIG. 10, to further enhance structural rigidity and stability (or as an alternative manner to provide rigidity and stability), an optional first cross beam 79 may connect a ninth portion 81 of the first bent tube frame 17 or 17' to a tenth portion 83 of the first bent tube frame 17 or 17'. Further, an optional second cross beam 85 may connect an eleventh portion 87 of the second bent tube frame 23 or 23' to a twelfth portion 89 of the second bent tube frame 23 or 23'.

Figure 8:
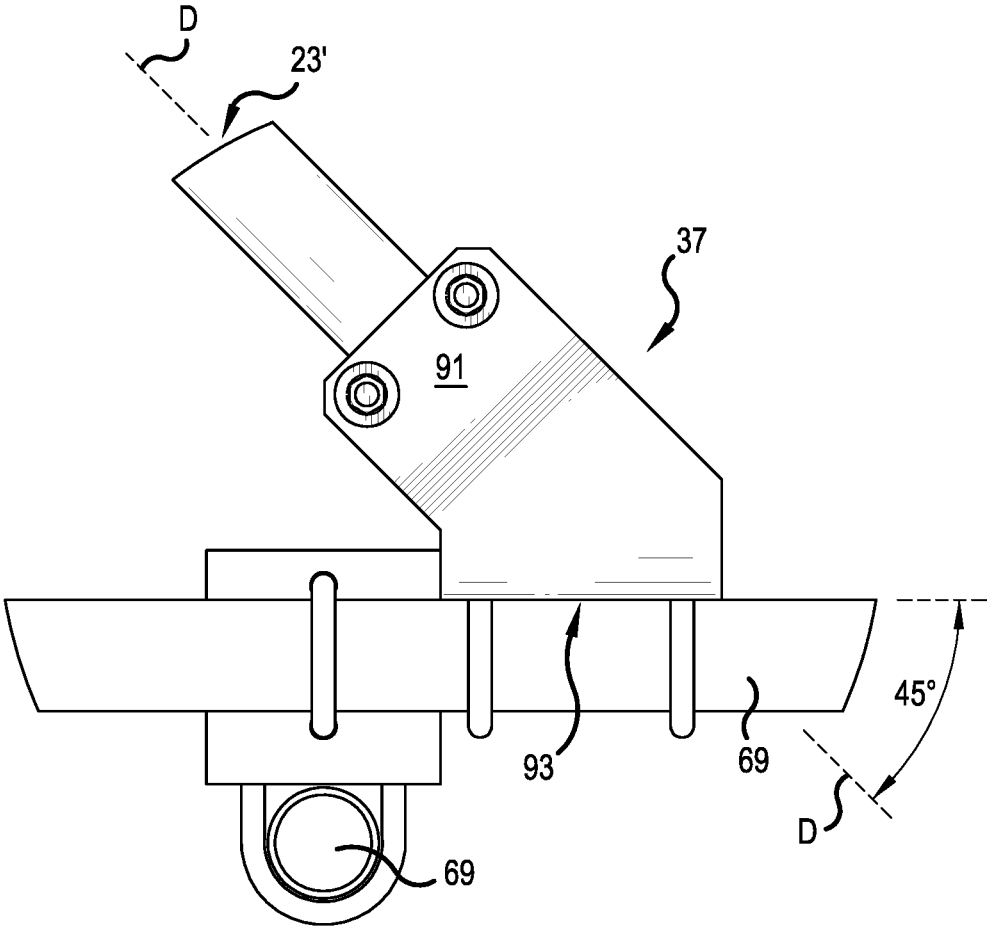
FIG. 8 is a close up, top view of a third equipment bracket of the antenna mount of FIG. 6.
Figure 9:
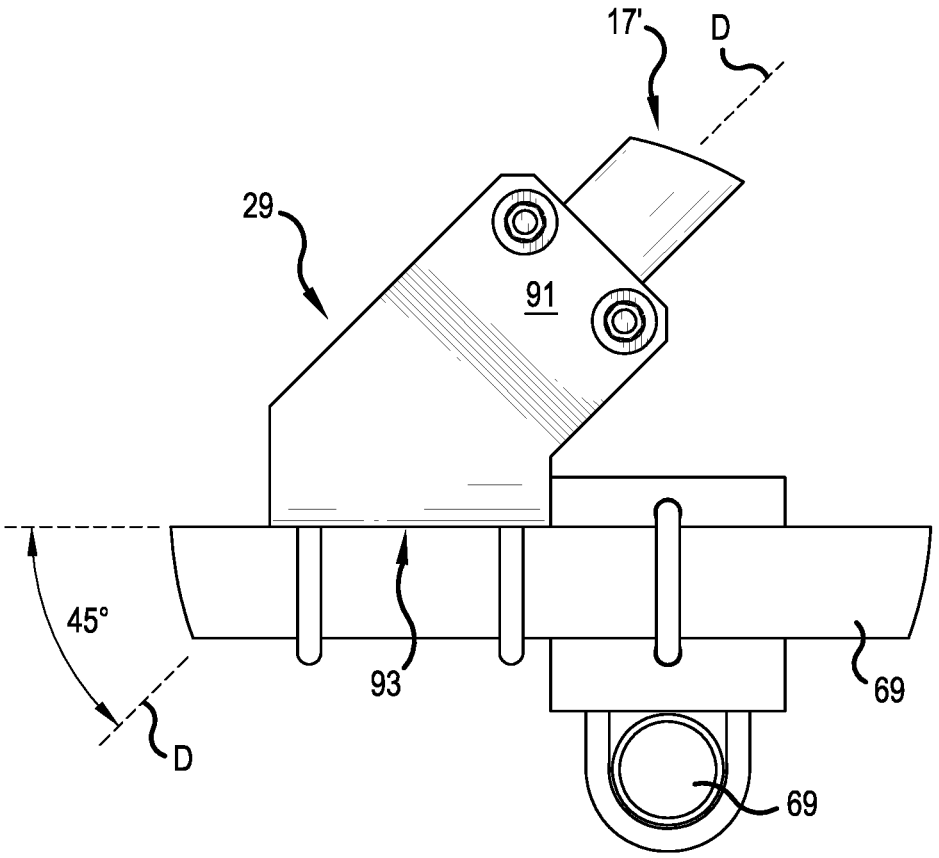
FIG. 9 is a close up, top view of a first equipment bracket of the antenna mount of FIG. 6.

As best seen in FIGS. 8 and 9, the third and first equipment brackets 37 and 29, respectively, each have a frame face 91 for attachment to the first bent tube frame 17 or 17' or second bent tube frame 23 or 23' and the equipment face 93 for attachment to equipment, e.g., the antenna frame 69. The frame face 91 resides in a plane which is orthogonal to a plane containing the equipment face 93. The frame face 91 extends in a direction D, which intersects the plane containing the equipment face 93 at an angle of approximately 10 to 80 degrees, more preferably at an angle of approximately 25 to 65 degrees, such as at an angle of approximately 45 degrees.

Likewise, the second and fourth equipment brackets 31 and 39 each have a frame face 91 for attachment to the first bent tube frame 17 or 17' and second bent tube frame 23 and 23', respectively, and the equipment face 93 for attachment to equipment, e.g., the antenna frame 69. The frame face 91 is orthogonal to the equipment face 93 and extends in a direction D which intersects a plane containing the equipment face 93 at an angle of approximately 10 to 80 degrees, more preferably at an angle of approximately 25 to 65 degrees, such as at an angle of approximately 45 degrees.

Figure 11:
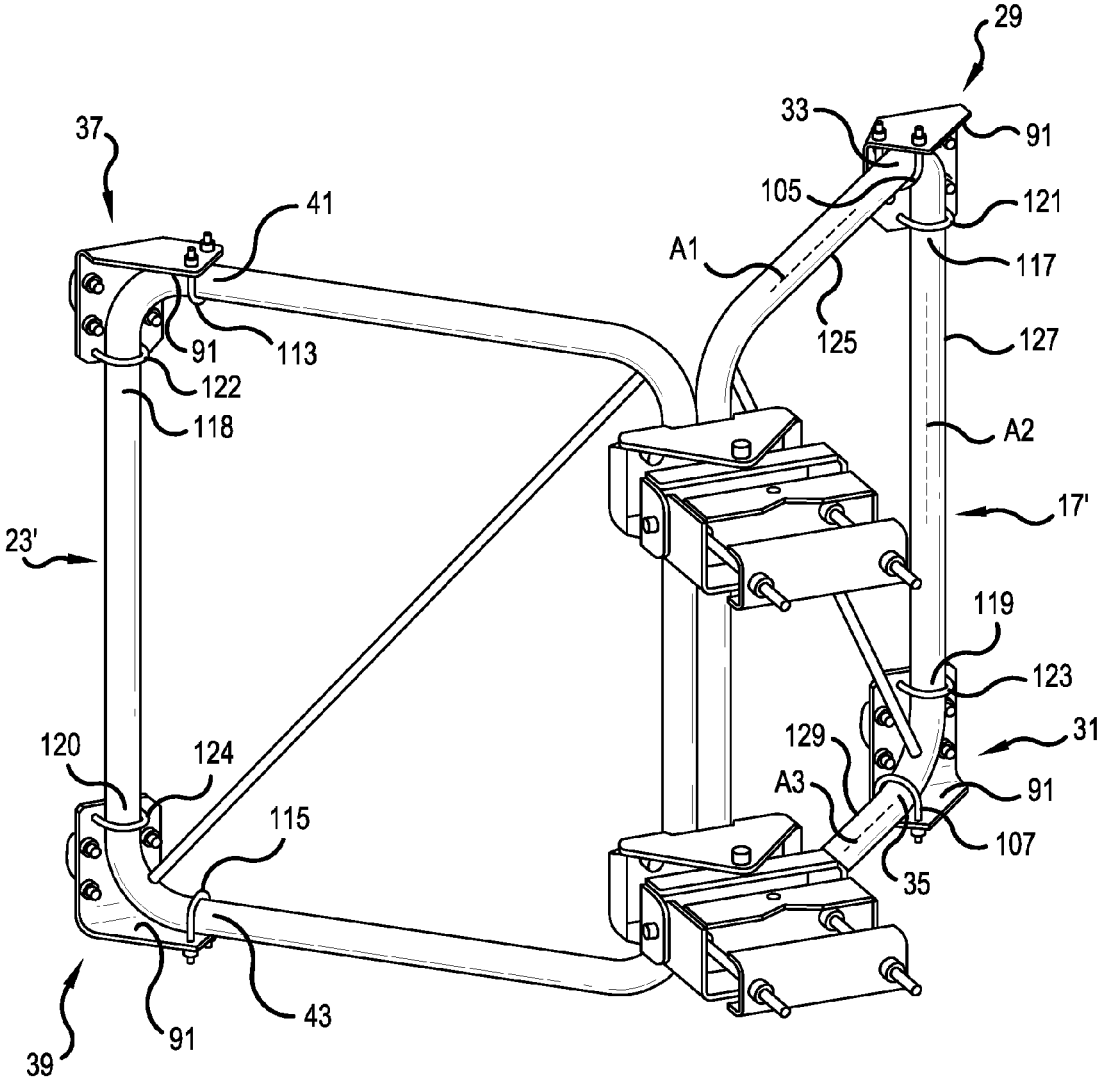
FIG. 11 is a rear perspective view of the antenna mount of FIG. 10.

As best seen in FIGS. 10 and 11, the frame faces 91 of the first and second equipment brackets 29 and 31 are attached to the fifth and sixth portions 33 and 35 of the first frame 17 or 17' by third and fourth U-bolts 105 and 107, respectively. The frame faces 91 of the third and fourth equipment brackets 37 and 39 are attached to the seventh and eighth portions 41 and 43 of the second frame 23 or 23' by fifth and sixth U-bolts 113 and 115, respectively. The equipment faces 93 of the first and second equipment brackets 29 and 31 are attached to thirteenth and fourteenth portions 117 and 119 of the first frame 17 or 17' by seventh and eighth U-bolts 121 and 123, respectively. The equipment faces 93 of the third and fourth equipment brackets 37 and 39 are attached to fifteenth and sixteenth portions 118 and 120 of the second frame 23 or 23' by ninth and tenth U-bolts 122 and 124, respectively.

The fifth portion 33 of the first frame 17 or 17' resides along a first segment 125 of the first frame 17 or 17', which extends along a first axis A1. The thirteenth portion 117 of the first frame 17 or 17' resides along a second segment 127 of the first frame 17 or 17', which extends along a second axis A2. The first axis A1 is substantially perpendicular to the second axis A2. The sixth portion 35 of the first frame 17 or 17' resides along a third segment 129 of the first frame 17 or 17', which extends along a third axis A3. The fourteenth portion 119 of the first frame 17 or 17' resides along the second segment 127 of the first frame 17 or 17', which extends along the second axis A2. The third axis A3 is substantially parallel to the first axis A1, and hence substantially perpendicular to the second axis A2.

The structure and attachments of the third and fourth equipment brackets 37 and 39 and the second frame 23 or 23' may be in the same fashions and orientations, as described in the above paragraphs.

Tube diameters of the first and second frames 17, 17', 23 or 23' may be between 1 to 3 inches, such as 1.5 to 2.5 inches, more preferably about 1.9 to 2.4 inches. The clamps have been illustrated as U-bolts 95, 97. However, the clamps may be formed in other manners, such as a plate or L-shape member using bolts to apply a frictional clamping force, or a strap which may be tightened to apply a frictional clamping force. The first and second frames 17, 17', 23 or 23' in FIGS. 1-11 have been depicted as tubular frames each with a circular cross-sectional shape. However, the tubular frame may optionally have other cross sectional shapes, such as oval, triangular, rectangular or square. Also, one or more of the advantages of the present invention may be obtained by non-tubular frame members, e.g., L-shaped frame members.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. An antenna mount comprising:

a first tower mounting bracket;

a second tower mounting bracket;

a first one-piece continuous bent tube frame, wherein said first bent tube frame has an elongate first portion attached to said first tower mounting bracket and an elongate second portion attached to said second tower mounting bracket, wherein the lengths of the first portion and the second portion extend toward each other and are coaxially aligned;

a second one-piece continuous bent tube frame, wherein said second bent tube frame has an elongate third portion attached to said first tower mounting bracket and an elongate fourth portion attached to said second tower mounting bracket, wherein the lengths of the third portion and the fourth portion extend toward each other and are coaxially aligned;

first and second equipment brackets attached to fifth and sixth portions of said first bent tube frame; and third and fourth equipment brackets attached to seventh and eighth portions of said second bent tube frame.

2. The antenna mount of claim 1, wherein said first bent tube frame presents a first C-shape, and wherein said second bent tube frame defines a second C-shape.

3. The antenna mount of claim 2, wherein an opening in said first C-shape of said first bent tube frame exists between said first portion attached to said first tower mounting bracket and said second portion attached to said second tower mounting bracket, and wherein an opening in said second C-shape of said second bent tube frame exists between said third portion attached to said first tower mounting bracket and said fourth portion attached to said second tower mounting bracket.

4. The antenna mount of claim 1, wherein said first bent tube frame is formed as a first closed loop, and wherein said second bent tube frame is formed as a second closed loop.

5. The antenna mount of claim 1, further comprising:

a first cross beam connecting a ninth portion of said first bent tube frame to a tenth portion of said first bent tube frame; and a second cross beam connecting an eleventh portion of said second bent tube frame to a twelfth portion of said second bent tube frame.

6. The antenna mount of claim 1, wherein said first and second equipment brackets each have a frame face for attachment to said first bent tube frame and an equipment face for attachment to equipment, and wherein said frame face is orthogonal to said equipment face as seen from the side of the first and second equipment brackets and extends in a direction which intersects a plane containing said equipment face at an angle between 10 to 80 degrees as seen from the top of the first and second equipment brackets; and wherein said third and fourth equipment brackets each have a frame face for attachment to said second bent tube frame and an equipment face for attachment to equipment, and wherein said frame face is orthogonal to said equipment face as seen from the side of the third and fourth equipment brackets and extends in a direction which intersects a plane containing said equipment face at an angle between 10 to 80 degrees as seen from the top of the third and fourth equipment brackets.

7. The antenna mount of claim 1, wherein said first portion of said first bent tube frame and said third portion of said second bent tube frame are located side-by-side and are both clamped to said first tower bracket by a same first clamp; and wherein said second portion of said first bent tube frame and said fourth portion of said second bent tube frame are located side-by-side and are both clamped to said second tower bracket by a same second clamp.

8. The antenna mount of claim 7, wherein said first and second equipment brackets each have a frame face for attachment to said first bent tube frame and an equipment face for attachment to equipment, and wherein said frame face is orthogonal to said equipment face as seen from the side of the first and second equipment brackets and extends in a direction which intersects a plane containing said equipment face at an angle between 10 to 80 degrees as seen from the top of the first and second equipment brackets; and wherein said third and fourth equipment brackets each have a frame face for attachment to said second bent tube frame and an equipment face for attachment to equipment, and wherein said frame face is orthogonal to said equipment face as seen from the side of the third and fourth equipment brackets and extends in a direction which intersects a plane containing said equipment face at an angle between 10 to 80 degrees as seen from the top of the third and fourth equipment brackets.

9. An antenna mount comprising:

a first tower mounting bracket;

a second tower mounting bracket;

a first frame, wherein said first frame has an elongate first portion attached to said first tower mounting bracket and an elongate second portion attached to said second tower mounting bracket, wherein the lengths of the first portion and the second portion extend toward each other and are coaxially aligned;

a second frame, wherein said second frame has an elongate third portion attached to said first tower mounting bracket and an elongate fourth portion attached to said second tower mounting bracket, wherein the lengths of the third portion and the fourth portion extend toward each other and are coaxially aligned;

first and second equipment brackets attached to fifth and sixth portions of said first frame; and third and fourth equipment brackets attached to seventh and eighth portions of said second frame, wherein said first portion of said first frame and said third portion of said second frame are located side-by-side and are both clamped to said first tower bracket by a same first clamp; and wherein said second portion of said first frame and said fourth portion of said second frame are located side-by-side and are both clamped to said second tower bracket by a same second clamp.

10. The antenna mount of claim 9, wherein said first frame defines a first C-shape, and wherein said second frame presents a second C-shape.

11. The antenna mount of claim 10, wherein an opening in said first C-shape of said first frame exists between said first portion attached to said first tower mounting bracket and said second portion attached to said second tower mounting bracket, and wherein an opening in said second C-shape of said second frame exists between said third portion attached to said first tower mounting bracket and said fourth portion attached to said second tower mounting bracket.

12. The antenna mount of claim 9, wherein said first frame is formed as first closed loop, and wherein said second frame is formed as a second closed loop.

13. The antenna mount of claim 9, wherein said first and second equipment brackets each have a frame face for attachment to said first frame and an equipment face for attachment to equipment, and wherein said frame face is orthogonal to said equipment face as seen from the side of the first and second equipment brackets and extends in a direction which intersects a plane containing said equipment face at an angle between 10 to 80 degrees as seen from the top of the first and second equipment brackets; and wherein said third and fourth equipment brackets each have a frame face for attachment to said second frame and an equipment face for attachment to equipment, and wherein said frame face is orthogonal to said equipment face as seen from the side of the third and fourth equipment brackets and extends in a direction which intersects a plane containing said equipment face at an angle between 10 to 80 degrees as seen from the top of the third and fourth equipment brackets.

14. The antenna mount of claim 13, wherein said frame faces of said first and second equipment brackets are attached to said fifth and sixth portions of said first frame by third and fourth U-bolts, respectively;

wherein said frame faces of said third and fourth equipment brackets are attached to said seventh and eighth portions of said second frame by fifth and sixth U-bolts, respectively;

wherein said equipment faces of said first and second equipment brackets are attached to thirteenth and fourteenth portions of said first frame by seventh and eighth U-bolts, respectively;

wherein said equipment faces of said third and fourth equipment brackets are attached to fifteenth and sixteenth portions of said second frame by ninth and tenth U-bolts, respectively;

wherein said fifth portion of said first frame resides along a first segment of said first frame which extends along a first axis, and said thirteenth portion of said first frame resides along a second segment of said first frame which extends along a second axis, and wherein said first axis is substantially perpendicular to said second axis; and wherein said sixth portion of said first frame resides along a third segment of said first frame which extends along a third axis, and said fourteenth portion of said first frame resides along said second segment of said first frame which extends along said second axis, and wherein said third axis is substantially parallel to said first axis.

15. An antenna mount comprising:

a first tower mounting bracket;

a second tower mounting bracket;

a first frame, wherein said first frame has a first portion attached to said first tower mounting bracket and a second portion attached to said second tower mounting bracket;

a second frame, wherein said second frame has a third portion attached to said first tower mounting bracket and a fourth portion attached to said second tower mounting bracket;

first and second equipment brackets attached to fifth and sixth portions of said first frame, wherein said first and second equipment brackets each have a frame face for attachment to said first frame and an equipment face for attachment to equipment, and wherein said frame face is orthogonal to said equipment face as seen from the side of the first and second equipment brackets and extends in a direction which intersects a plane containing said equipment face at a first angle between 10 to 80 degrees as seen from the top of the first and second equipment brackets; and third and fourth equipment brackets attached to seventh and eighth portions of said second frame, wherein said third and fourth equipment brackets each have a frame face for attachment to said second frame and an equipment face for attachment to equipment, and wherein said frame face is orthogonal to said equipment face as seen from the side of the third and fourth equipment brackets and extends in a direction which intersects a plane containing said equipment face at a second angle between 10 to 80 degrees as seen from the top of the third and fourth equipment brackets.

16. The antenna mount of claim 15, further comprising:

an antenna frame mounted to said equipment faces of said first, second, third and fourth equipment brackets by first, second, third and fourth equipment bolts, respectively, and wherein said first and second angles are the approximately the same and are approximately 25 to 65 degrees.

17. The antenna mount of claim 15, wherein said frame faces of said first and second equipment brackets are attached to said fifth and sixth portions of said first frame by third and fourth U-bolts, respectively; and wherein said frame faces of said third and fourth equipment brackets are attached to said seventh and eighth portions of said second frame by fifth and sixth U-bolts, respectively.

18. The antenna mount of claim 17, wherein said equipment faces of said first and second equipment brackets are attached to thirteenth and fourteenth portions of said first frame by seventh and eighth U-bolts, respectively; and wherein said equipment faces of said third and fourth equipment brackets are attached to fifteenth and sixteenth portions of said second frame by ninth and tenth U-bolts, respectively.

19. The antenna mount of claim 18, wherein said fifth portion of said first frame resides along a first segment of said first frame which extends along a first axis, and said thirteenth portion of said first frame resides along a second segment of said first frame which extends along a second axis, and wherein said first axis is substantially perpendicular to said second axis.

20. The antenna mount of claim 19, wherein said sixth portion of said first frame resides along a third segment of said first frame which extends along a third axis, and said fourteenth portion of said first frame resides along said second segment of said first frame which extends along said second axis, and wherein said third axis is substantially parallel to said first axis.

* * * * *